US007299796B2

(12) United States Patent
Kirwan

(10) Patent No.: US 7,299,796 B2
(45) Date of Patent: Nov. 27, 2007

(54) GAS POWERED GUN WITH PRIMARY AND SECONDARY PISTONS

(76) Inventor: Lee Kirwan, 790 Second Street, Wyoming, Ontario (CA) N0N 1T0

( * ) Notice: Subject to any disclaimer, the term of this patent is extended or adjusted under 35 U.S.C. 154(b) by 411 days.

(21) Appl. No.: 11/101,523

(22) Filed: Apr. 8, 2005

(65) Prior Publication Data

US 2006/0225718 A1 Oct. 12, 2006

(51) Int. Cl.
*F41B 11/00* (2006.01)

(52) U.S. Cl. ..... 124/71; 124/72; 124/73; 124/74; 124/75; 124/76; 124/77

(58) Field of Classification Search ..... 124/71–77
See application file for complete search history.

(56) References Cited

U.S. PATENT DOCUMENTS 5,613,483 A * 3/1997 Lukas et al. ..... 124/73
6,901,689 B1 * 6/2005 Bergstrom ..... 42/1.06

* cited by examiner

*Primary Examiner*—Troy Chambers

(74) *Attorney, Agent, or Firm*—Robert F. Delbridge

(57) ABSTRACT

A gas powered gun has a gun barrel, a cylinder containing a primary piston moveable between a loading position and a firing position, a secondary piston moveable within the primary piston between a loading position in which the leading end of the secondary piston is sufficiently withdrawn in the barrel to permit a projectile to be fed into the barrel through an opening in the side thereof and a firing position in which the secondary piston has moved forwardly to cause the leading end of the secondary piston to engage the projectile and move the projectile forwardly in the barrel. A trigger is operable to cause the primary piston and the secondary piston to move simultaneously from the loading position to the firing position. The cylinder has a chamber through which the primary piston and the secondary piston extend. A pressurized gas supply supplies pressurized gas to the chamber when the primary piston and the secondary piston are in the loading position, the primary piston and the secondary piston isolate the chamber from the pressurized gas supply when the primary piston and the secondary piston are in the firing position and cause pressurized gas from the chamber to be ejected from the leading end of the secondary piston to fire a projectile from the barrel. Thus, movement of the secondary piston between the loading and firing positions has two components, one component being movement with the main piston and the other component being movement relative to the main piston.

2 Claims, 2 Drawing Sheets

GAS POWERED GUN WITH PRIMARY AND SECONDARY PISTONS

FIELD OF INVENTION

This invention relates to gas powered guns.

BACKGROUND OF INVENTION

Gas powered guns are used for example in the sport known as Paintball in which spherical projectiles containing coloured liquid are fired at an opponent and burst upon hitting the opponent so that the coloured liquid is deposited on the opponent. The spherical projectile is propelled from the gun by a pressurized gas, usually carbon dioxide or compressed air, which is supplied from a small cylinder attached to the gun.

U.S. Pat. No. 5,613,483 (Lukas et al.) issued Mar. 25, 1997 describes a firing gas control mechanism which controls the burst of gas which fires a projectile from the barrel of the gun. The mechanism taught by Lukas et al. includes a cylinder containing a piston rod slideably moveable between a loading position in which the leading end of the piston rod is sufficiently withdrawn in the barrel to permit a projectile to be fed into the barrel through an opening in the side thereof, and a firing position in which the piston rod has moved forwardly to cause the leading end of the piston rod to engage the projectile and move the projectile forwardly in the barrel, whereupon a burst of gas propels the projectile from the barrel. The contents of the Lukas et al. patent are hereby incorporated herein by reference.

It has been found, that with the Lukas et al. mechanism, the piston rod cannot be made to recycle quickly enough to provide the required modern day firing rate without pneumatically unbalancing the piston to cause a faster forward motion and a slower back motion and without the likelihood of the mechanism being jammed by a projectile being fed into the barrel prior to firing.

It is therefore an object of this invention to provide a gas powered gun with a firing gas control system which can operate in a faster manner than the firing gas control mechanism described in the above-mentioned patent.

SUMMARY OF INVENTION

According to one aspect of the present invention, a gas powered gun comprises a gun barrel, a cylinder containing a primary piston moveable between a loading position and a firing position, a secondary piston moveable within the primary piston between a loading position in which the leading end of the secondary piston is sufficiently withdrawn in the barrel to permit a projectile to be fed into the barrel through an opening in the side thereof, and a firing position in which the secondary piston has moved forwardly to cause the leading end of the secondary piston to engage the projectile and move the projectile forwardly in the barrel, a trigger operable to cause the primary piston and the secondary piston to move simultaneously from the loading position to the firing position, a pressurized gas supply, the cylinder having a chamber through which the primary piston and the secondary piston extend, said pressurized gas supply supplying pressurized gas to the chamber when the primary piston and the secondary piston are in the loading position, said primary piston and the secondary piston isolating the chamber from the pressurized gas supply when the primary piston and the secondary piston are in the firing position and causing pressurized gas from the chamber to be ejected from the leading end of the secondary piston to fire a projectile from the barrel, whereby movement of the secondary piston between the loading and firing positions has two components, one component being movement with the main piston and the other component being movement relative to the main piston.

According to another aspect of the invention, a piston and cylinder for a gas powered gun comprises a cylinder containing a primary piston moveable between a loading position and a firing position, a secondary piston moveable within the primary piston between a loading position and a firing position, said cylinder having a chamber through which the primary piston and secondary piston extend, said primary piston and secondary piston enabling pressurized gas to be supplied to the chamber when the primary piston and the secondary piston are in the loading position, said primary piston and secondary piston isolating the chamber from a pressurized gas supply when the main piston and the secondary piston are in the firing position and causing pressurized gas from the chamber to be ejected from the leading end of the secondary piston, whereby movement of the secondary piston between the loading and firing positions has two components, one component being movement with the main piston and the other component being movement relative to the main piston.

DESCRIPTION OF THE DRAWINGS

One embodiment of the invention will now be described by way of example with reference to the accompanying drawings, of which.

DESCRIPTION OF PREFERRED EMBODIMENT

Figure 1:
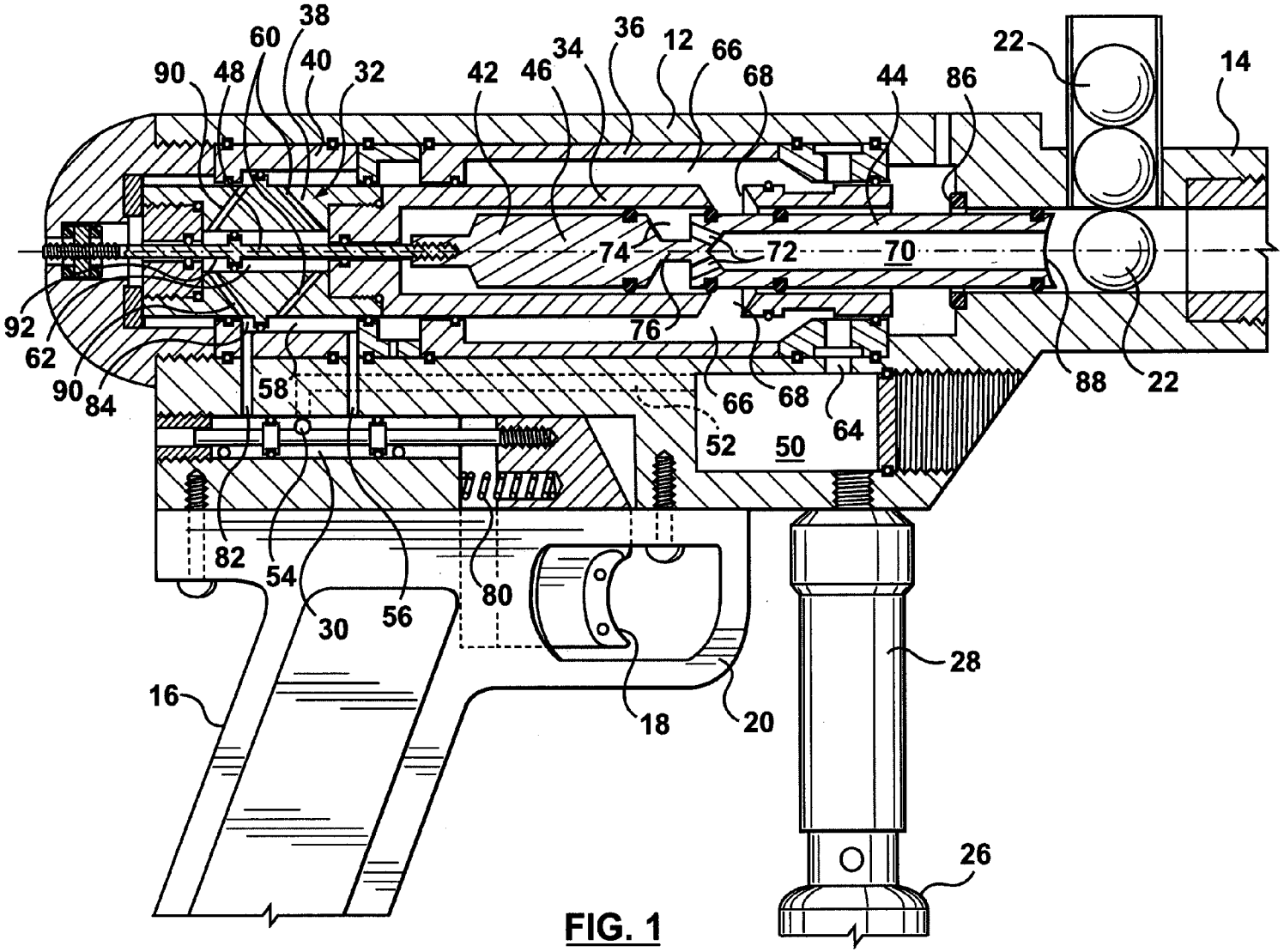
FIG. 1 is a diagrammatic sectional view of a paintball gun showing the firing control mechanism in the loading position.

Referring to the drawings, a paintball gun has a housing 12 with a barrel 14 secured to and projecting from the forward end of the housing 12. A handgrip 16 is secured to the bottom of the housing 12, with a trigger 18 and trigger guard 20 being secured to the bottom of the housing 12 in front of the handgrip 16. Paintballs 22 are fed downwardly into the barrel 14 through a supply passage 24. Pressurized gas is supplied from a carbon dioxide cylinder 26 which is attached to the lower end of a pressure regulator 28 whose upper end is secured to the bottom of the housing 12 forwardly of the trigger 18. The housing 12 contains a spool valve 30 which is actuated by operation of the trigger 18 to supply pressurized gas from the cylinder 26 to firing control mechanism in a manner to cause loading and firing operation thereof. As so far described, the paintball gun is similar to the paintball gun described in previously mentioned U.S. Pat. No. 5,613,483.

In accordance with the invention, the firing control mechanism includes a primary piston 32 with a forward portion 34 sideably mounted in a forward cylinder 36 mounted in the housing 12 and a rear portion 38 sideably mounted in a rear cylinder 40 mounted in the housing 12. The firing control mechanism also includes a secondary piston 42 with front and intermediate pistons 44, 46 sideably mounted in the forward portion 34 of the primary piston 32 and a rear piston 48 slideably mounted in the rear portion 38 of the primary piston 32.

When the firing control mechanism is in the loading position as shown in FIG. 1, the trigger 18 and the spool valve 30 are in the rearward positions shown. Pressurized gas from the regulator 28 passes through a gas reservoir 50 and a passage 52 in the housing 12 to a central location 54 in the spool valve 30. In the rearward position of the spool valve 30, pressurized gas from the location 54 passes through a passage 56 in the housing 12 to an annular chamber 58 surrounding the rear portion 38 of the primary piston 32 to maintain the primary piston 32 in the rear position. Pressurized gas in the annular chamber 58 passes through passages 60 in the rear portion 38 of primary piston 32 into an annular chamber 62 surrounding the rear portion 48 of the secondary piston 42 to maintain the secondary piston 42 in the rear position.

Also, in the loading position shown in FIG. 1, pressurized gas in the gas reservoir 50 flows through an aperture 64 into an annular chamber 66 in the forward cylinder 36 surrounding the forward portion 34 of the primary piston 32. The forward portion 34 of the primary piston 32 has radially extending passages 68 therethrough, the radially inner ends of which are closed by the front portion 44 of the secondary piston 42. The front portion 44 of the secondary piston 42 has a horizontally extending main inner passage 70 which extends from its front end rearwardly to passages 72 which connect the main passage 70 to an annular chamber 74 surrounding a neck 76 between the front and intermediate portions 44, 46 of the secondary piston 42.

It will be understood that the firing control mechanism will be provided with necessary sealing rings and bleeds to atmosphere, as will be readily apparent to a person skilled in the art.

Figure 2:
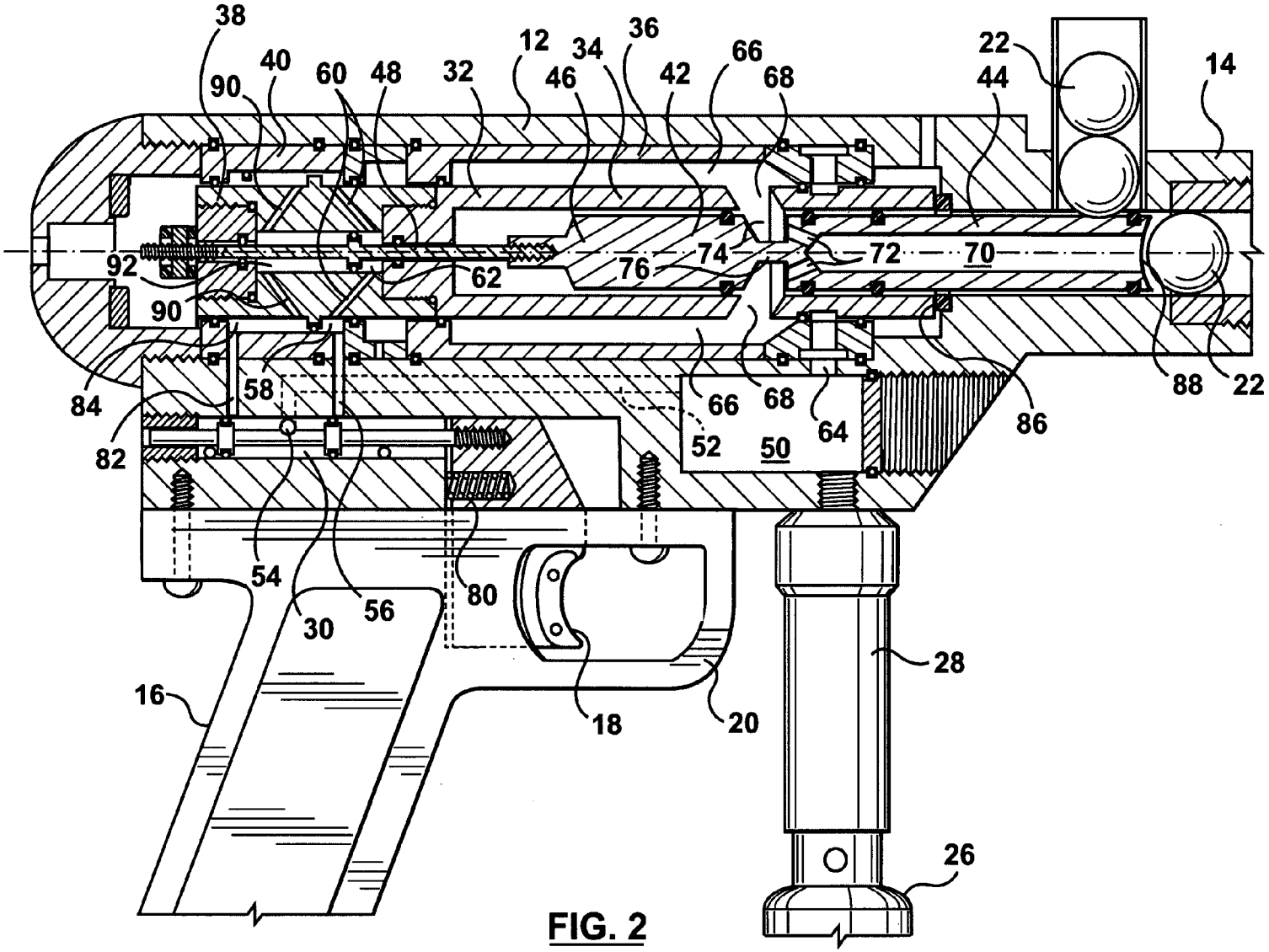
FIG. 2 is a similar view showing the firing control mechanism in the firing position.

To fire a paintball 22 from the gun, the trigger 18 is pulled back to move the spool valve 30 to the firing position shown in FIG. 2. It will be noted that a return spring 80 acts between the trigger 18 and the housing 12 to bias the trigger 18 to the loading position. Pressurized gas in the spool valve 30 then no longer communicates with passage 56 but instead communicates with passage 82 and an annular chamber 84 surrounding the rear portion 38 of primary piston 32. The primary piston 32 is consequently moved to the forward position shown in FIG. 2, the forward movement of the primary piston 32 being limited by engagement with a shoulder 86 formed by the housing 12. The secondary piston 42 moves forwardly with the primary piston 32 so that the front end 88 of the forward portion 44 of the secondary piston 42 engages a paintball 22 and moves it towards the barrel 14.

At the same time, pressurized gas in the annular chamber 84 passes through passages 90 in the rear portion 38 of the primary piston 32 and into an annular chamber 92 surrounding a rear most portion 94 of the secondary piston 42, thereby causing the secondary piston 42 to move forwardly relative to the primary piston 32 as shown in FIG. 2. This results in two events. Firstly, the front end 88 of the forward portion 44 of the secondary piston 42 moves the next paintball 22 into the barrel 14. Secondly, the forwardly movement of the secondary piston 42 relative to the primary piston 32 causes the pressurized gas in the annular chamber 66 to pass through the passages 68, annular chamber 74 and passages 72 into the chamber 70 in the forward portion 44 of the secondary piston 42, thereby firing a projectile 22 from the barrel 14.

It will be noted that, when the firing control mechanism is in the firing position shown in FIG. 2, the annular chamber 66 is isolated from the gas reservoir 50. Thus, it is the predetermined volume of pressurized gas in the annular chamber 66 which effects the firing of the projectile 22.

When the trigger 18 is released and consequently returns to the position shown in FIG. 1, the primary piston 32 and the secondary piston 42 are caused to return to the positions shown in FIG. 1.

Thus, both when moving from the loading position to the firing position and when moving from the firing position to the loading position, movement of the secondary piston 42 has two components, the first component being movement with the primary piston 32 and the second component being movement relative to the primary piston 32. Consequently, movement of the forward portion 44 of the secondary piston 42 towards and away from the barrel 14 is very rapid, thereby enabling the firing control mechanism to be operated at a relatively high speed without causing jamming of the mechanism by the next paintball 22 to be fired.

The advantages and other embodiments of the invention will now be readily apparent to a person skilled in the art, the scope of the invention being defined in the appended claims.

The invention claimed is:

1. A gas powered gun comprising:

a gun barrel, a cylinder containing a primary piston moveable between a loading position and a firing position, a secondary piston moveable within the primary piston between a loading position in which the leading end of the secondary piston is sufficiently withdrawn in the barrel to permit a projectile to be fed into the barrel through an opening in the side thereof, and a firing position in which the secondary piston has moved forwardly to cause the leading end of the secondary piston to engage the projectile and move the projectile forwardly in the barrel, a trigger operable to cause the primary piston and the secondary piston to move simultaneously from the loading position to the firing position, a pressurized gas supply, the cylinder having a chamber through which the primary piston and the secondary piston extend, said pressurized gas supply supplying pressurized gas to the chamber when the primary piston and the secondary piston are in the loading position, said primary piston and the secondary piston isolating the chamber from the pressurized gas supply when the primary piston and the secondary piston are in the firing position and causing pressurized gas from the chamber to be ejected from the leading end of the secondary piston to fire a projectile from the barrel, whereby movement of the secondary piston between the loading and firing positions has two components, one component being movement with the main piston and the other component being movement relative to the main piston.

2. A piston and cylinder assembly for a gas powered gun, said piston and cylinder comprising:

a cylinder containing a primary piston moveable between a loading position and a firing position, a secondary piston moveable within the primary piston between a loading position and a firing position, said cylinder having a chamber through which the primary piston and secondary piston extend, said primary piston and secondary piston enabling pressurized gas to be supplied to the chamber when the primary piston and the secondary piston are in the loading position, said primary piston and secondary piston isolating the chamber from a pressurized gas supply when the main piston and the secondary piston are in the firing position and causing pressurized gas from the chamber to be ejected from the leading end of the secondary piston, whereby movement of the secondary piston between the loading and firing positions has two components, one component being movement with the main piston and the other component being movement relative to the main piston.

* * * * *